US005516992A

United States Patent [19]

Dohnal et al.

[11] Patent Number: 5,516,992

[45] Date of Patent: May 14, 1996

[54] TRANSFORMER TAP CHANGING AND STEP SWITCH ASSEMBLY

[75] Inventors: Dieter Dohnal, Lappersdorf; Josef Neumeyer, Waldetzenberg, both of Germany

[73] Assignee: Maschinenfabrik Reinhausen GmbH, Regensburg, Germany

[21] Appl. No.: 313,206

[22] PCT Filed: May 6, 1993

[86] PCT No.: PCT/EP93/01114

§ 371 Date: Sep. 27, 1994

§ 102(e) Date: Sep. 27, 1994

[87] PCT Pub. No.: WO93/23861

PCT Pub. Date: Nov. 25, 1993

[30] Foreign Application Priority Data

May 15, 1992 [DE] Germany ..... 42 16 034.0
Nov. 4, 1992 [DE] Germany ..... 42 37 242.9

[51] Int. Cl.[6] ..... H01F 29/04; H01H 15/08; H01H 19/54; H01H 21/62

[52] U.S. Cl. ..... 200/11 TC; 323/340; 323/341; 336/150

[58] Field of Search ..... 200/1 R, 8 R, 200/8 A, 11 B, 11 J, 11 TC, 11 TW, 17 R, 18; 323/255, 256, 340, 341; 336/150

[56] References Cited

U.S. PATENT DOCUMENTS

| | | | |
|---|---|---|---|
| 1,985,927 | 1/1935 | Jansen | 336/148 |
| 2,036,305 | 4/1936 | Snyder | 323/340 |
| 3,177,307 | 4/1965 | Weber et al. | 200/11 B |
| 3,192,328 | 6/1965 | Wilson, Jr. | 200/11 B |
| 3,581,188 | 5/1971 | Watanabe | 323/340 |
| 3,628,128 | 12/1971 | Buhler | 323/340 |
| 4,504,811 | 3/1985 | Stunzi | 336/10 |
| 4,562,316 | 12/1985 | Kranich, II | 200/16 D |
| 4,644,112 | 2/1987 | Kranich, II | 200/16 F |

FOREIGN PATENT DOCUMENTS

| | | | |
|---|---|---|---|
| 293541 | 10/1971 | Austria | H01F 37/00 |
| 2518306 | 6/1983 | France | H01F 29/02 |
| 2603734 | 3/1988 | France | H01F 29/02 |
| 2712484 | 9/1978 | Germany | H01F 29/02 |
| 3630415 | 3/1988 | Germany | H01F 29/02 |
| 62-10973 | of 1987 | Japan . | |
| 391088 | 4/1965 | Switzerland . | |

OTHER PUBLICATIONS

"Ofentransformatoren zum Speisen von Lichtbogenöfen mit Ofenschalter im Zwischenkreis" by R. Brehler, published in Siemens Periodical 50 (1976), vol. 1, pp. 9–17.

*Primary Examiner*—J. R. Scott
*Attorney, Agent, or Firm*—Herbert Dubno; Andrew Wilford

[57] ABSTRACT

A cast-resin transformer has a transformer housing, a plurality of windings each having a plurality of taps, respective contacts connected to the taps and mounted on the housing in respective arrays which are all identical, and respective identical mounting elements on the housing at each of the contact arrays. Respective identical step switches each serve a respective winding of the transformer and each have a switch housing secured to the respective mounting element of the transformer housing at the respective contact array and a step contact movable along the respective connector elements and electrically engageable therewith. A drive motor and a main shaft are connected to all of the step contacts for synchronously stepping the step contacts along the respective connector elements.

7 Claims, 6 Drawing Sheets

FIG. 3
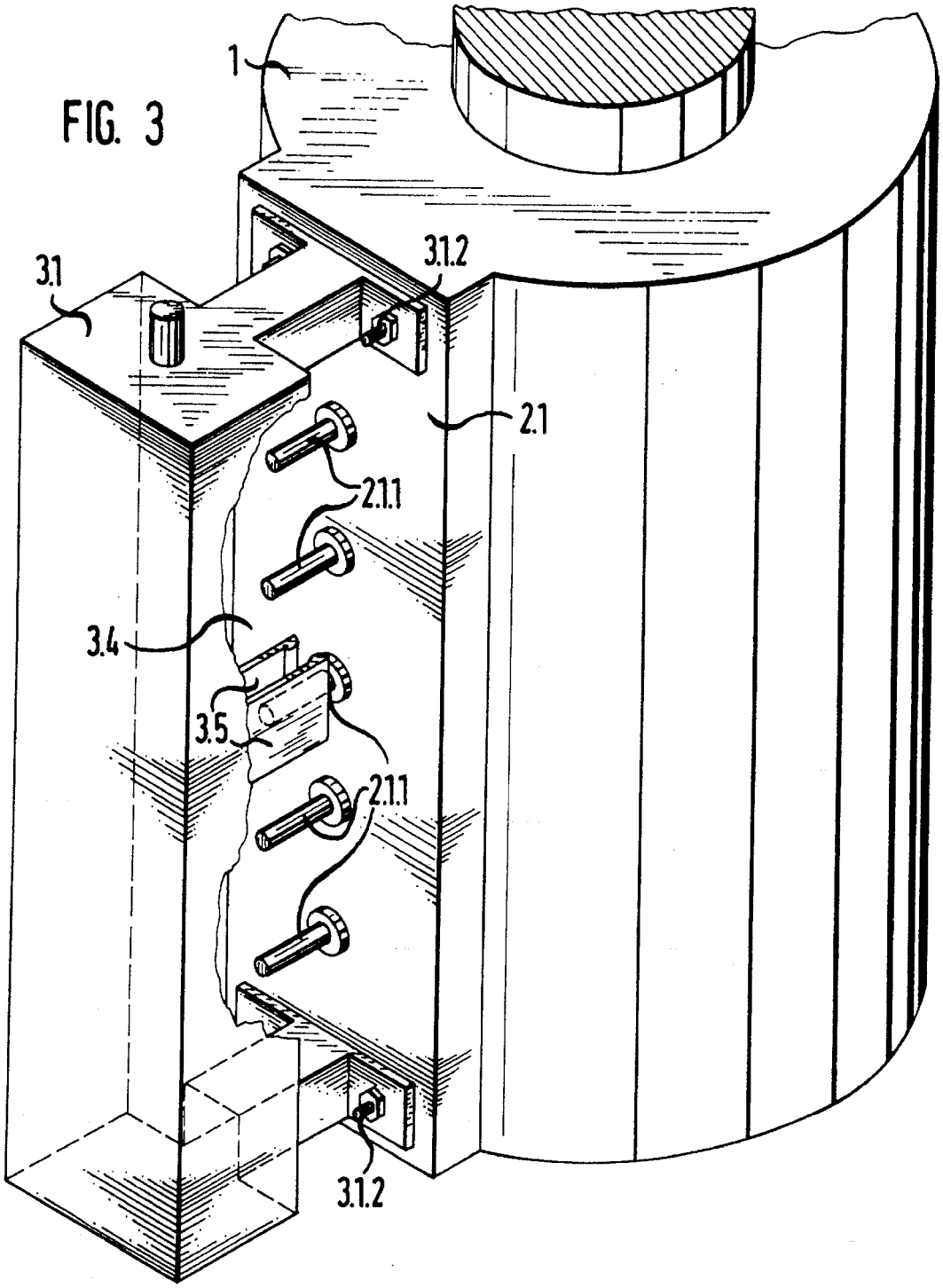
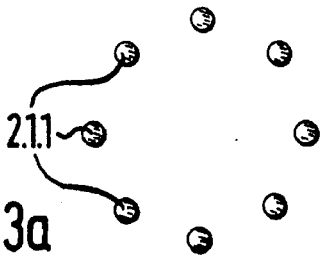
FIG. 3a

TRANSFORMER TAP CHANGING AND STEP SWITCH ASSEMBLY

CROSS REFERENCE TO RELATED APPLICATIONS

This application is the U.S. national phase of PCT application PCT/EP93/01114 filed 6 May 1993 with a claim to the priorities of German applications P 42 16 034.0 filed 15 May 1992 and P 42 37 242.9 filed 4 Nov. 1992.

FIELD OF THE INVENTION

The present invention relates to a step switch of the type connectable with a single- or polyphase step transformer where the taps of the step winding are externally accessible. Such a step switch is particularly usable with cast-resin transformers.

BACKGROUND OF THE INVENTION

Cast-resin transformers of the described type are for example known from the product literature "Technische Information Giessharz-Transformatoren" of Starkstrom-Ger ätebau GmbH of Regensburg (1985). Such dry transformers are increasingly popular, in particular in the region up to about 600A due to their simpler construction and not the least because of the environmental advantage with respect to clophene- or oil-insulated transformers.

With these transformers the connector conductors and with them the taps of an existing step winding lead to connector tabs on the output coil rails or directly on the core sleeve of the cast-resin winding and there are connected by connection lines with the step switch.

German patent 3,630,415 describes using a conventional oil-filled step switch which is mounted on a support laterally adjacent the transformer and which is connected electrically by connection lines.

Swiss patent 391,088 further describes an arrangement where the connections are extended out of the transformer to contacts which are arranged like a collar around the periphery of a cylindrical housing in which the step switch is recessed so that same is connectable by respective contacts on the outside of the step-switch housing electrically with the collar of contacts and therethrough with the transformer.

Another built-on step switch of the load-selector type for oil transformers is known from German published application 2,712,484 which has a grid that fixes and guides the connection lines between the step contacts and the respective transformer.

Finally a cast-resin transformer is known from Japanese utility model Sho-62-10,973 wherein the connections of the step winding are extended to a cast-in-place contact plate whence they are extended by electrical connector lines to a step switch.

All these known arrangement have substantial disadvantages.

First in every case there are a plurality of electrical connections on the step switch with the respective taps of the transformer by means of numerous electrical lines. This is expensive, requires special means for mechanically fixing these conductors and for avoiding electrical interaction, and does not in addition allow for a change of connectors for example during assembly or repair. It is further disadvantageous that the adjacent step switch must be fixed near the transformer by means of special holders, traverses, struts, or the like that are not normally provided on or needed by the transformer. This means further that the respective step switch must not only be matched in every case to the electrical characteristics of the transformer, its number of steps, and so on, but also to the respective mechanical and constructive circumstances, such as size, type, style, and position of the electrical connections and of the mechanical mounting means and so on.

OBJECTS OF THE INVENTION

It is an object of the invention to provide a built-on step switch which is simply electrically connected to and mechanically mounted on step transformers, in particular on cast-resin insulated step transformers of different types and construction.

SUMMARY OF THE INVENTION

A cast-resin transformer has a transformer housing, a plurality of windings each having a plurality of taps, respective contacts connected to the taps and mounted on the housing in respective arrays which are all identical, and respective identical mounting elements on the housing at each of the contact arrays. Respective identical step switches each serve a respective winding of the transformer and each have a switch housing secured to the respective mounting element of the transformer housing at the respective contact array and a step contact movable along the respective connector elements and electrically engageable therewith. A drive motor and a main shaft are connected to all of the step contacts for synchronously stepping the step contacts along the respective connector elements.

This invention has numerous advantages. To start with there are none of the prior-art standard connections with all of their known problems, possibility of mistake, and the like since the modular step switch according to the invention is mounted directly on the respective cast step winding of the transformer. In addition this very direct connection of the step switch and the electrical connections as well as the mechanical mounting means in a single space eliminates expensive mounting devices, supports, traverses, and the like. Due to the corresponding "section places" on the step transformer and on the step switch simple configurations are possible.

The technical embodiment of the step switch as identically constructed single-phase step-switch modules has the advantage of maximum simplification. The step-switch modules have one-piece connector elements and mounting means by means of which they are connectable directly with the connection and contact means on the cast-resin transformer. In a particularly advantageous embodiment of the invention the housing of the step-switch module has at least one cavity through whose interior in mounted condition the mounting and connector elements of the step transformer extend and by which they are directly actuatable as step contacts. To this end these connector elements are formed on their free ends preferably as electrodes and are arranged in a circle or along a straight line.

It can be advantageous in a further embodiment of the invention to connect the step-switch module mechanically and electrically via contact and/or mounting adapters with the respective step transformers. In this manner no change in the step-switch module itself is necessary to fit it to changed connector and mounting systems but only a relatively simple different adapter is needed.

BRIEF DESCRIPTION OF THE DRAWING

The invention is described below by way of example with reference to the drawings.

FIGS. 3 and 3A show a second embodiment of these elements also in perspective view.

SPECIFIC DESCRIPTION

Figure 1:
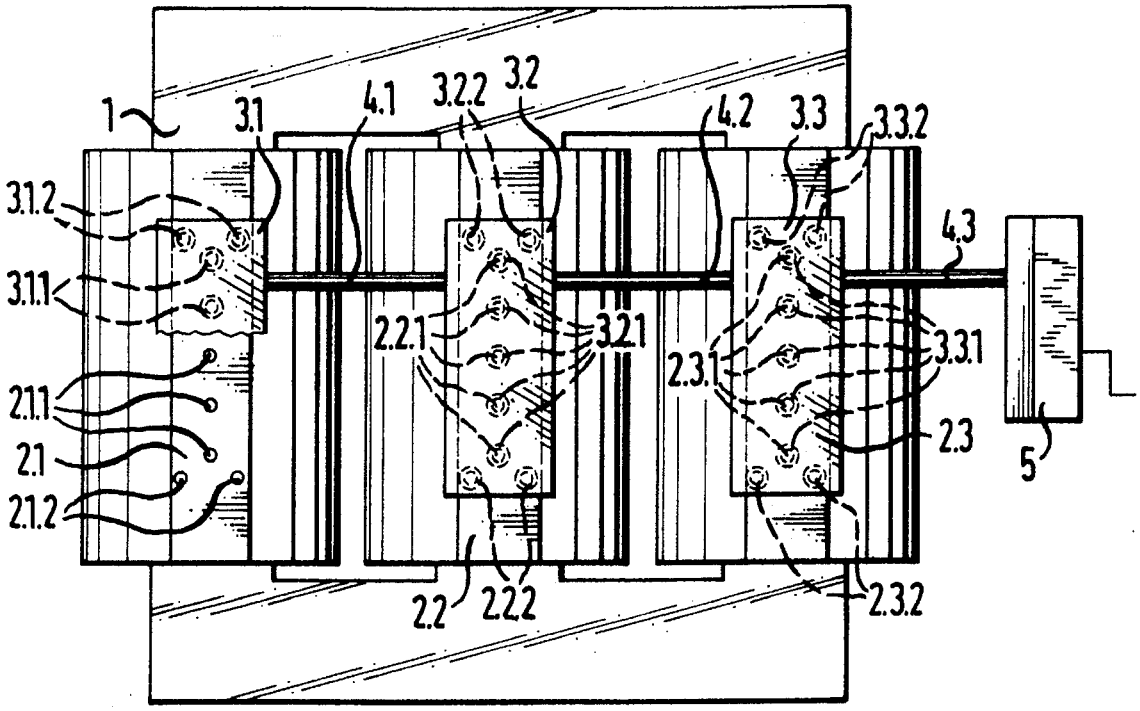
FIG. 1 shows schematically the arrangement of a modular step switch according to the invention with a cast-resin step transformer.

A three-phase step transformer 1 which is formed as a cast-resin transformer has for each phase a connection terminal 2.1, 2.2, and 2.3. These connection terminals 2.1, 2.2, and 2.3 have in respective similar geometric arrangements electrical connection elements 2.1.1, 2.2.1, and 2.3.1 which are each connected with the respective taps of the step winding of the respective phase. They further have mechanical mounting means 2.1.2, 2.2.2, and 2.3.2. Each connection terminal is electrically and mechanically connected to a respective single-phase identically constructed step-switch module 3.1, 3.2, and 3.3. The connection is made by electrical connector elements 3.1.1, 3.2.1, and 3.3.1 as well as by corresponding mechanical mounting means 3.1.2, 3.2.2, and 3.3.2 at the respective step-switch modules.

Figure 1A:
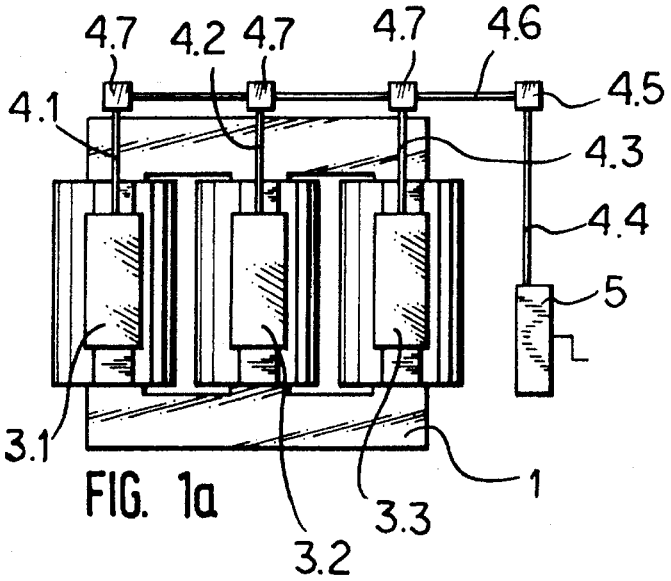
FIG. 1*a* shows an alternative arrangement.

The joint synchronous actuation of the step-switch modules is done by drive shafts 4.1, 4.2, 4.3 which are connected to a common motor drive 5. FIG. 1*a* shows schematically a further example of the arrangement of the drive shaft with the drive motor 5 having an output shaft 4.4 connected via a right-angle drive 4.5 to a secondary shaft 4.5 connected through respective right-angle drives 4.7 with the drive shafts 4,1, 4.2, and 4.3 of the respective step switches 3.1, 3.2, and 3.3.

Figure 2:
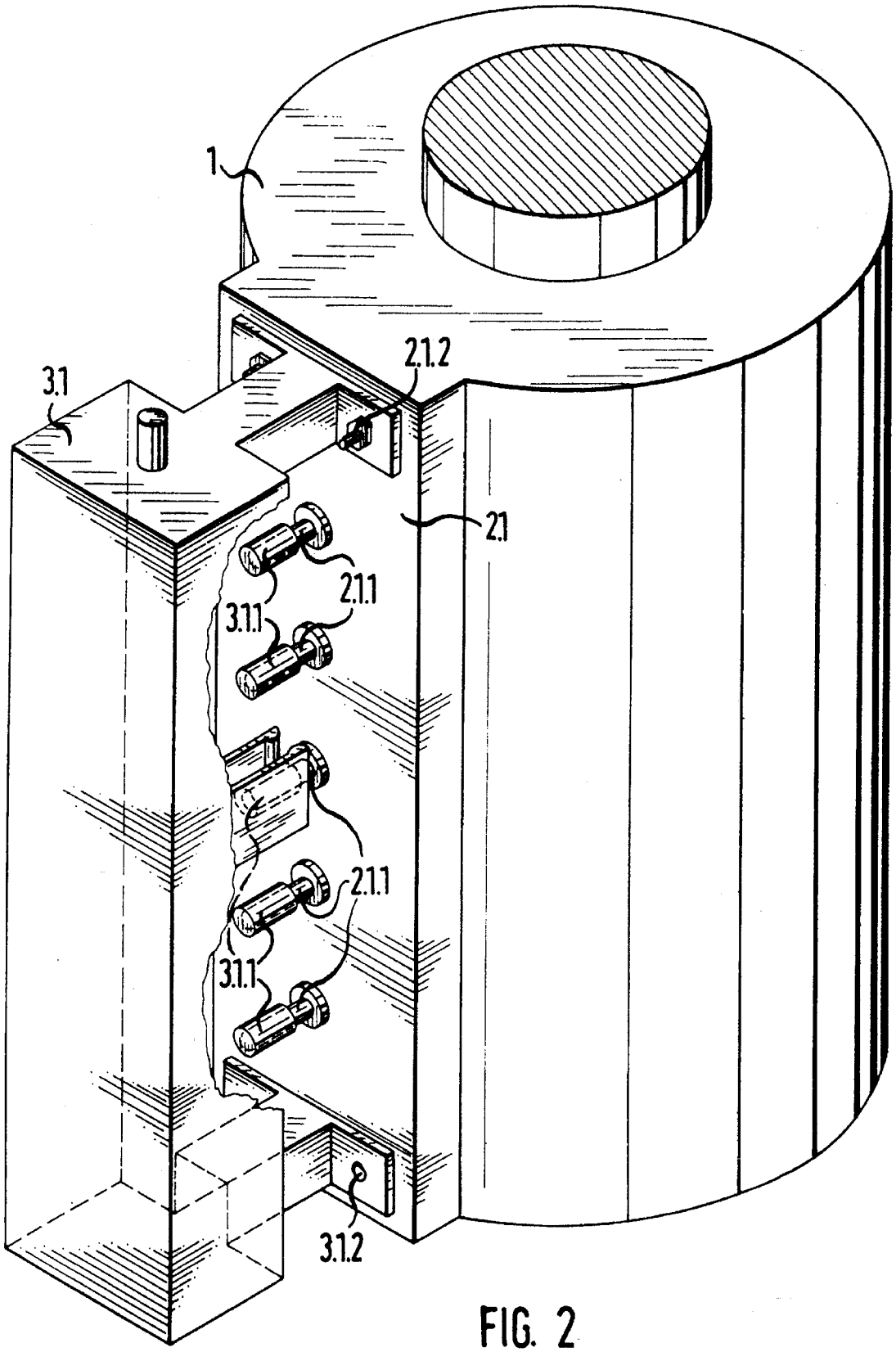
FIG. 2 shows in a perspective view the interactive connection and mounting elements.

FIG. 2 shows a connection terminal 2.1 of the step transformer 1 as well as a hereto connected step-switch module 3.1 in more detail. A plurality of connector elements 2.1.1 arranged vertically above one another each correspond to a respective tap of the step winding and are constituted as plugs; flanking them are mounting means 2.1.2, for example studs. The step-switch module 3.1 has geometrically complementary electrical connector elements 3.1.1 formed as contact sleeves or clips which grip the connector elements 2.1.1 and also has complementary mounting means 3.1.2, in this case bores in a flange, so that the step-switch module 3.1 can be secured by nuts with the respective connector terminal 2.1.1. The complementary construction of the interengaging pairs of electrical connector elements and mechanical mounting means can be set up any way depending on the respective electrical requirements and load and the mechanical and spatial relationships. It is sure that in every case only a single step-switch module is necessary regardless of the number of phases of the transformer. Each step-switch module is a complete single-phase step switch in particular equipped with its own force-storage unit for snap actuation. Such step-switch modules are particularly advantageous as single-phase load selectors which can be made particularly small when they combine step preselection and noninterruptive load switching. It is furthermore naturally particularly advantageous to make the step-switch modules in dry construction since then no separate sealing of the oil chamber is necessary. Finally it is also possible to form the step-switch modules as load-free switching selectors, linear selectors, and the like so as to further simplify the entire arrangement since for example the force-storage unit is not needed and also before switching from one step to the next the transformer is shut off.

It is further advantageous to form the electrical connector elements on the connector terminal so that they extend into the interior of the closed step-switch module and there are switched directly as contacts between which the switching takes place. Such an arrangement is shown in FIG. 3. Here with a connector terminal 2.1 unchanged from FIG. 2 the electrical connector elements 2.1.1, which are also arranged in a vertical row, are formed on their free ends as electrodes. The step-switch module 3.1 fixed on the connector terminal 2.1 does in fact have corresponding mounting means 3.1.2 but no separate electrical connector elements are provided. On the contrary there is in the housing of the step-switch module 3.1 a cavity 3.4 which is open toward the connector terminal 2.1 and in which the electrode-like free ends of the electrical connector elements 2.1.1 extend into the interior of the step-switch module 3.1 and there directly form the fixed switchable step contacts of the step transformer on which at least one movable step-selector and/or load-selector contact 3.5 engages.

FIG. 3*a* shows an alternative arrangement of the electrical connector elements; this circular arrangement is also ideal in order to form the fixed step contacts directly which then are switched by a centrally pivotal contact bridge in the known manner.

Figure 4:
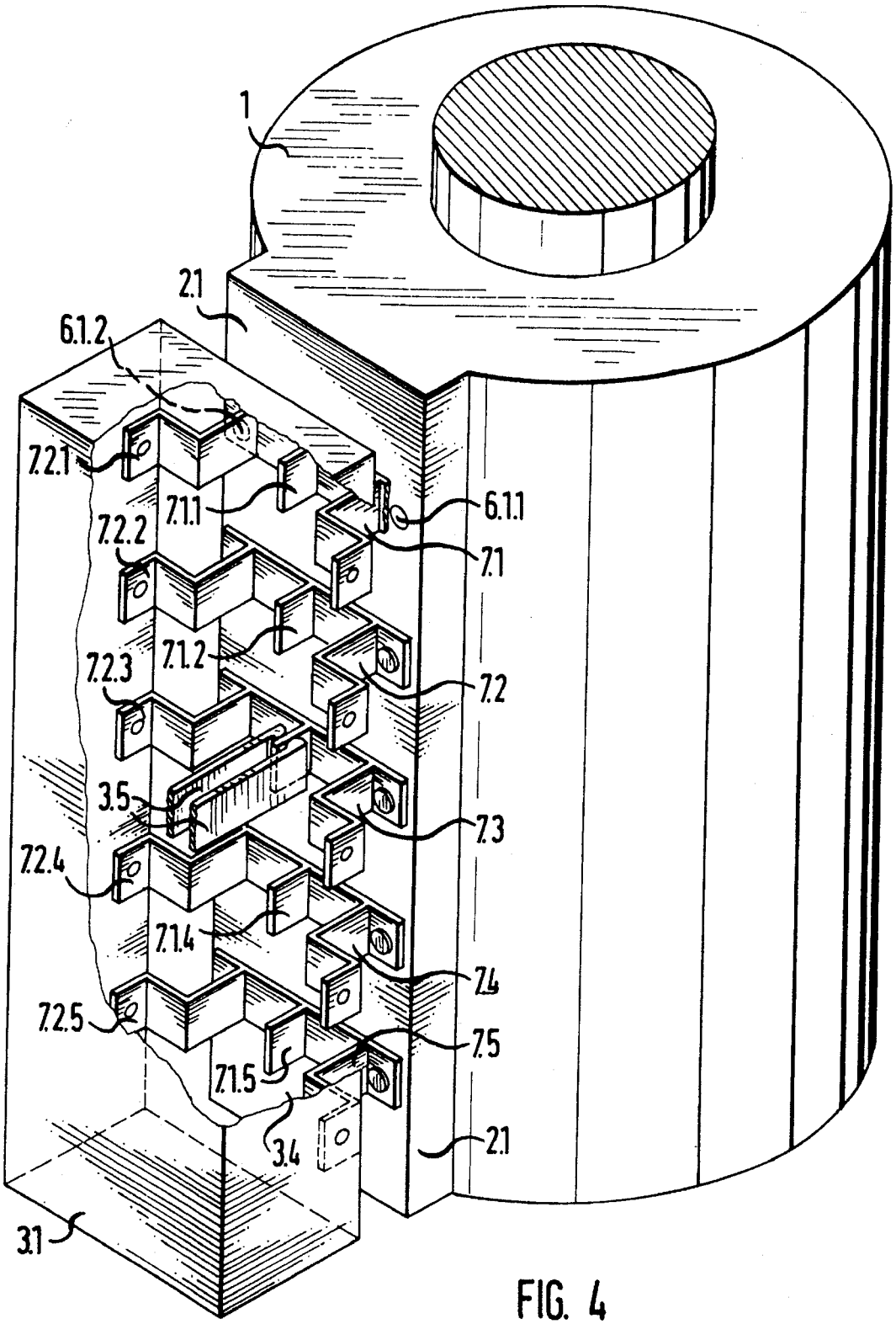
FIG. 4 shows a third embodiment of these elements also in perspective view.

FIG. 4 shows a further embodiment. Here the step-switch module 3.1 also has a cavity 3.4 which is open toward the connector terminal 2.1. As a variation of the invention here however the electrical conductors are formed as cast-in-place threaded sleeves 6.1.1 . . . 6.5.2 where each electrical connection has two adjacent threaded sleeves 6.n.1 and 6.n.2. Parts 7.1 . . . 7.5 screwed to the pairs of adjacent threaded sleeves form step contacts 7.1.1 . . . 7.1.5 which work with a movable contact 3.5 and which have tabs 7.2.1 . . . 7.2.5 on which the step-switch module is mounted. Thus the functions of the electrical connector elements and the mechanical mounting means are combined.

Figure 5:
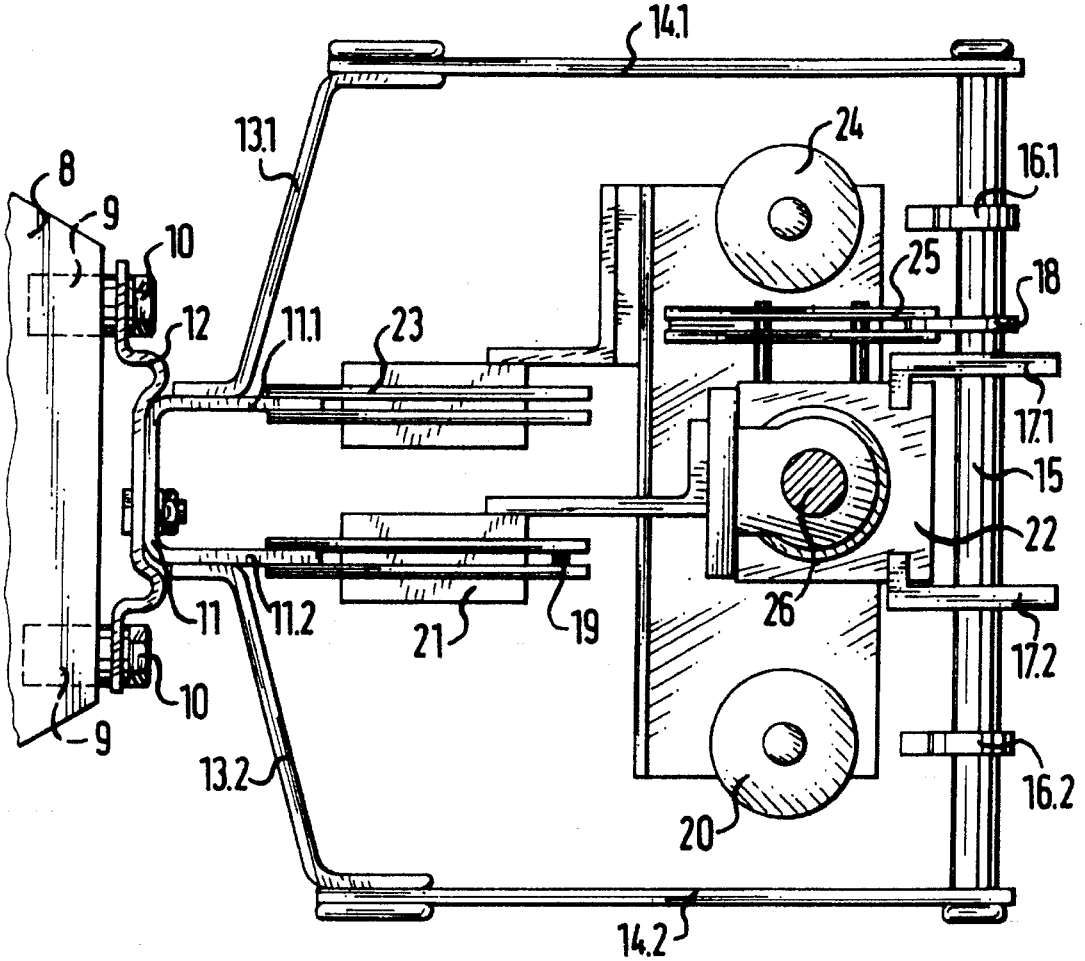
FIG. 5 shows in section from above a further embodiment of a modular step switch according to the invention.

FIG. 5 shows from above a single-phase step switch according to the invention. A cast-resin transformer has on the front side of each winding 8 a vertical row of contact sleeves 9 which are each connected with a tap of the step winding as has been described above. In this embodiment two threaded sleeves 9 at the same potential are arranged horizontally next to each other and are secured by bolts 10 with the respective one-piece step contact 11 directly or via a conductive spacer 12. Each of the identically formed step contacts 11 which are arranged in a vertical row has two parallel contact blades 11.1 and 11.2 which extend parallel to each other inside the housing of the step switch.

The two contact blades 11.1 and 11.2 are bolted to two housing parts 13.1 and 13.2 which are symmetrical as seen from above; these form with two side plates 14.1 and 14.2, for example of insulating material, and two horizontal guide bolts 15 the housing of the step switch. In this system the rear side of the housing that is turned away from the fixed contacts is open; it is of course also possible to provide a closed cover plate or the like instead of the two parallel horizontal spacer bolts 15. Between the horizontal spacer bolts 15 and extending vertically parallel to each other is at least one, here two, cam rails 16.1 and 16.2 and at least one, here two, guide rails 17.1 and 17.2 and at least one output rail 18. In addition secured to unillustrated struts inside the housing—also extending vertically through same—is a further contact rail 19 which is connected via a not further illustrated shunt resistor R and a switch 20 with the output rail 18.

Figure 6:
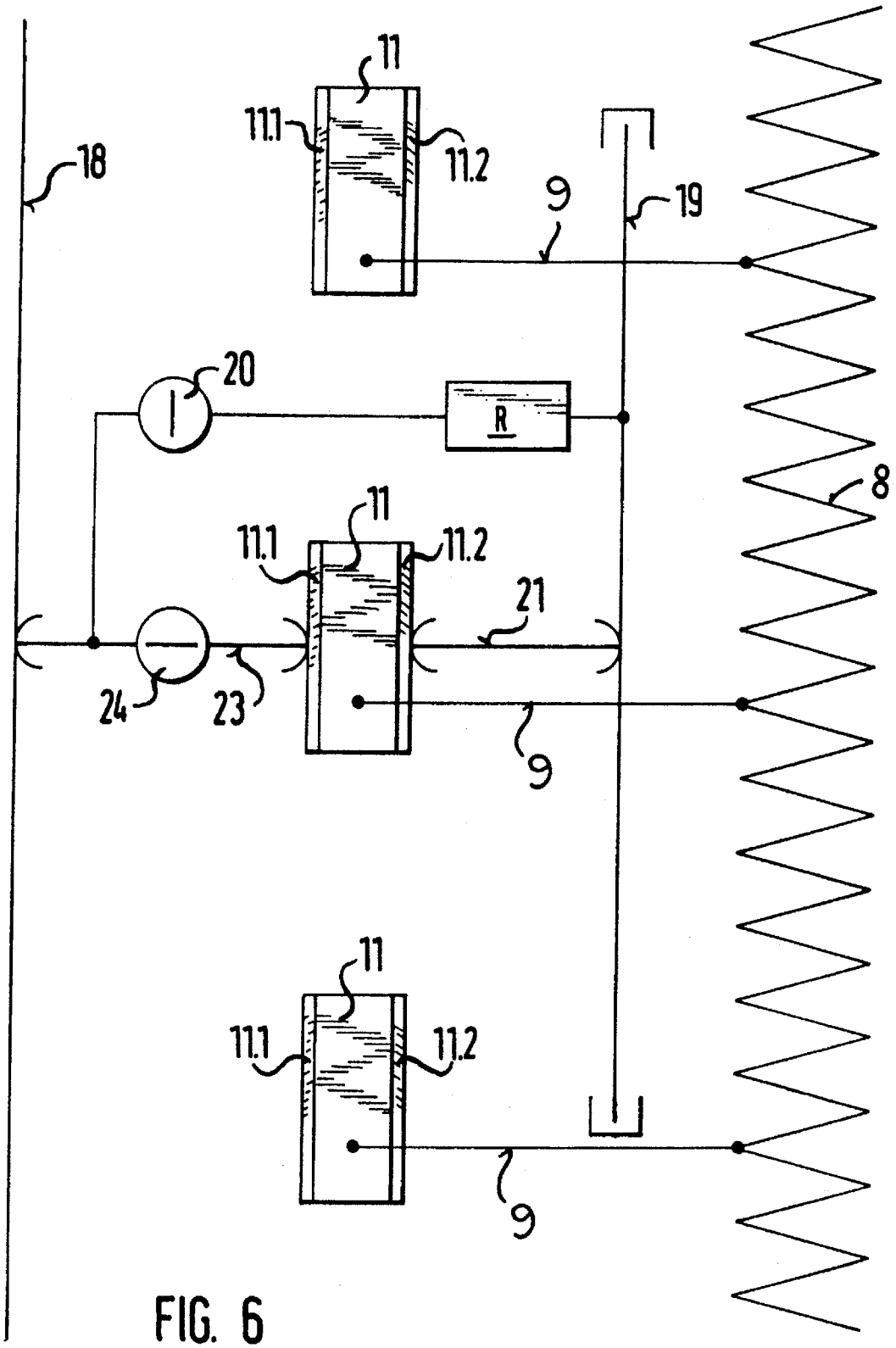
FIG. 6 shows a possible switching system for one of these step switches.

FIG. 6 shows the schematic of such a step switch according to FIG. 5. The drive shaft 26 which extends from above into the housing and which has a threaded spindle vertically moves a first contact bridge 21 which can slide over the contact blades 11.2 of the fixed step contacts 11 and also loads a diagrammatically illustrated force-storage unit 22 vertically in a direction which is dependent on the rotation direction of the drive shaft 26. Its release is triggered by unillustrated spring-loaded pawls which are actuated by the cam rails 16.1 and 16.2. In its snap-action vertical movement in which it follows the first contact bridge 21, the force-storage unit 22 which carries a second contact bridge 23 is mechanically guided by the guide rails 17.1 and 17.2. The second contact bridge 23 connects the other contact blade 11.1 of the fixed step contact 11 via a second switch 24 with the output line 18, preferably through a further contact bridge 25. The switches 20 and 24 are preferably vacuum switches whose actuation is controlled also by the shape of the already provided cam rails 16.1 and 16.2.

We claim:

1. In combination:

a cast-resin transformer having a transformer housing, a plurality of windings each having a plurality of taps, respective contacts connected to the taps and mounted on the housing in respective arrays which are all identical, and respective identical mounting elements on the housing at each of the contact arrays;

respective identical step switches each serving a respective winding of the transformer and each having a switch housing secured to the respective mounting element of the transformer housing at the respective contact array, and a step contact movable along the respective connector elements and electrically engageable therewith; and drive means including a drive motor and a main shaft connected to all of the step contacts for synchronously stepping the step contacts along the respective connector elements.

2. The combination defined in claim 1 wherein the mounting elements are threaded and the switch housings are directly bolted to the transformer housing.

3. The combination defined in claim 1 wherein the switch housing is a hollow casing open only toward the transformer housing.

4. The combination defined in claim 1 wherein the step switch each further comprise respective connector elements on the respective contacts engageable with the respective step contact.

5. The combination defined in claim 4 wherein the connector elements form the mounting elements.

6. The combination defined in claim 5 wherein each connector element is formed as a blade and is fixed to side plates of insulating material forming part of the respective switch housing.

7. The combination defined in claim 5 wherein the connector elements are in a vertical row and each step switch further includes a vertical cam rail fixed in the respective switch housing, a vertical guide rail fixed in the respective switch housing, an output rail fixed in the respective switch housing, a drive shaft rotatable in the housing by the main shaft, a force-storage unit in the housing operable by the respective drive shaft, a fixed contact bridge directly actuated by the respective drive shaft and displaceable along the respective row of contacts, a shunt resistor and first switch connected between the fixed contact bridge and the output rail, a movable contact bridge actuated by the force-storage unit and displaceable along the respective row of contacts, and a second switch connected between the movable contact bridge and the output rail.

* * * * *